US007129909B1

(12) United States Patent
Dong et al.

(10) Patent No.: US 7,129,909 B1
(45) Date of Patent: Oct. 31, 2006

(54) METHOD AND SYSTEM USING COMPRESSED DISPLAY MODE LIST

(75) Inventors: Yu Dong, Saratoga, CA (US); Dongyi Liao, Santa Clara, CA (US); Gregory P. Kwok, Berkeley, CA (US)

(73) Assignee: nVidia Corporation, Santa Clara, CA (US)

( * ) Notice: Subject to any disclaimer, the term of this patent is extended or adjusted under 35 U.S.C. 154(b) by 358 days.

(21) Appl. No.: 10/423,387

(22) Filed: Apr. 25, 2003

Related U.S. Application Data

(60) Provisional application No. 60/461,714, filed on Apr. 9, 2003.

(51) Int. Cl.
*G09G 5/00* (2006.01)

(52) U.S. Cl. ..... 345/1.1; 410/8

(58) Field of Classification Search ..... 345/1.1–3.4; 710/8, 14; 708/203
See application file for complete search history.

(56) References Cited

U.S. PATENT DOCUMENTS 4,955,066 A * 9/1990 Notenboom ..... 382/240
6,483,502 B1 * 11/2002 Fujiwara ..... 345/213
2003/0222876 A1 * 12/2003 Giemborek et al. ..... 345/503

* cited by examiner

*Primary Examiner*—Bipin Shalwala
*Assistant Examiner*—Tom Sheng

(57) ABSTRACT

A method and system using a compressed display mode list is disclosed. In particular, the compressed display mode list includes a plurality of data representing the display modes. The data is formatted according to a plurality of compression format rules. The compression format rules reduce and minimize the size of the compressed display mode list. A driver controls a graphical processing unit that renders an image for displaying on a display device according to a selected display mode from the compressed display mode list. Moreover, a computer-readable medium can store the compressed display mode list.

35 Claims, 15 Drawing Sheets

100A

MODE TYPE

STANDARD CHIP ID | HEADER | COLOR BIT DEPTH | RESOLUTION (H, V) | REFRESH RATE, $H_Z$

| | | | | | |
|---|---|---|---|---|---|
| HKR,, NV17_MODES, 85 100 120 0" | %REG_MULT_SZ%, | "8 | 640 | 480 | 60 70 72 75 |
| HKR,, NV17_MODES, 0" | %REG_SZ_APPEND%, | "8 | 320 | 200 | 60 70 72 75 |
| HKR,, NV17_MODES, 0" | %REG_SZ_APPEND%, | "8 | 320 | 240 | 60 70 72 75 |
| HKR,, NV17_MODES, 0" | %REG_SZ_APPEND%, | "8 | 400 | 300 | 60 70 72 75 |
| HKR,, NV17_MODES, 0" | %REG_SZ_APPEND%, | "8 | 480 | 360 | 60 70 72 75 |
| HKR,, NV17_MODES, 0" | %REG_SZ_APPEND%, | "8 | 512 | 384 | 60 70 72 75 |
| HKR,, NV17_MODES, 85 100 120 0" | %REG_SZ_APPEND%, | "8 | 640 | 400 | 60 70 72 75 |
| HKR,, NV17_MODES, 85 100 120 0" | %REG_SZ_APPEND%, | "8 | 800 | 600 | 60 70 72 75 |
| HKR,, NV17_MODES, 85 100 120 0" | %REG_SZ_APPEND%, | "8 | 1024 | 768 | 60 70 72 75 |
| HKR,, NV17_MODES, 85 100 120 0" | %REG_SZ_APPEND%, | "8 | 1152 | 864 | 60 70 72 75 |
| HKR,, NV17_MODES, 85 100 120 0" | %REG_SZ_APPEND%, | "8 | 1280 | 768 | 60 70 72 75 |
| HKR,, NV17_MODES, 85 100 120 0" | %REG_SZ_APPEND%, | "8 | 1280 | 960 | 60 70 72 75 |
| HKR,, NV17_MODES, 85 100 120 0" | %REG_SZ_APPEND%, | "8 | 1280 | 1024 | 60 70 72 75 |
| HKR,, NV17_MODES, 85 100 0" | %REG_SZ_APPEND%, | "8 | 1600 | 900 | 60 70 72 75 |
| HKR,, NV17_MODES, 85 100 0" | %REG_SZ_APPEND%, | "8 | 1600 | 1024 | 60 70 72 75 |
| HKR,, NV17_MODES, 85 100 0" | %REG_SZ_APPEND%, | "8 | 1600 | 1200 | 60 70 72 75 |
| HKR,, NV17_MODES, 85 100 0" | %REG_SZ_APPEND%, | "8 | 1920 | 1080 | 60 70 72 75 |
| HKR,, NV17_MODES, 85 0" | %REG_SZ_APPEND%, | "8 | 1920 | 1200 | 60 70 72 75 |
| HKR,, NV17_MODES 0" | %REG_SZ_APPEND%, | "8 | 1920 | 1440 | 60 70 72 75 |
| HKR,, NV17_MODES 0" | %REG_SZ_APPEND%, | "8 | 2048 | 1536 | 60 |

FIGURE 1A
(PRIOR ART)

100A

MODE TYPE

STANDARD CHIP ID

HEADER

COLOR BIT DEPTH

RESOLUTION

REFRESH RATE, $H_Z$

| | | | H | V | |
|---|---|---|---|---|---|
| HKR,, NV17_MODES, 85 100 120 0" | %REG_MULT_SZ%, | "8 | 640 | 480 | 60 70 72 75 |
| HKR,, NV17_MODES, 85 100 120 0" | %REG_SZ_APPEND%, | "16 | 640 | 480 | 60 70 72 75 |
| HKR,, NV17_MODES, 0" | %REG_SZ_APPEND%, | "16 | 320 | 200 | 60 70 72 75 |
| HKR,, NV17_MODES, 0" | %REG_SZ_APPEND%, | "16 | 320 | 240 | 60 70 72 75 |
| HKR,, NV17_MODES, 0" | %REG_SZ_APPEND%, | "16 | 400 | 300 | 60 70 72 75 |

FIGURE 1A
(PRIOR ART) CONT.

100B

CHIP ID | HEADER | COLOR BIT DEPTH | RESOLUTION (H, V) | REFRESH RATE, $H_Z$

| | | | | | |
|---|---|---|---|---|---|
| HKR,, NV20_MODES, 85 100 120 0" | %REG_MULT_SZ%, | "8 | 800 | 600 | 60 70 72 75 |
| HKR,, NV20_MODES, 85 100 120 0" | %REG_SZ_APPEND%, | "8 | 1024 | 768 | 60 70 72 75 |
| HKR,, NV20_MODES, 85 100 120 0" | %REG_SZ_APPEND%, | "8 | 1152 | 864 | 60 70 72 75 |
| HKR,, NV20_MODES, 85 100 120 0" | %REG_SZ_APPEND%, | "8 | 1280 | 768 | 60 70 72 75 |
| HKR,, NV20_MODES, 85 100 120 0" | %REG_SZ_APPEND%, | "8 | 1280 | 960 | 60 70 72 75 |
| HKR,, NV20_MODES, 85 100 120 0" | %REG_SZ_APPEND%, | "8 | 1280 | 1024 | 60 70 72 75 |
| HKR,, NV20_MODES, 85 100 0" | %REG_SZ_APPEND%, | "8 | 1600 | 900 | 60 70 72 75 |
| HKR,, NV20_MODES, 85 100 0" | %REG_SZ_APPEND%, | "8 | 1600 | 1024 | 60 70 72 75 |
| HKR,, NV20_MODES, 85 100 0" | %REG_SZ_APPEND%, | "8 | 1920 | 1200 | 60 70 72 75 |
| HKR,, NV20_MODES, 85 100 0" | %REG_SZ_APPEND%, | "8 | 1920 | 1080 | 60 70 72 75 |
| HKR,, NV20_MODES, 85 0" | %REG_SZ_APPEND%, | "8 | 1920 | 1200 | 60 70 72 75 |
| HKR,, NV20_MODES, 0" | %REG_SZ_APPEND%, | "8 | 1920 | 1440 | 60 70 72 75 |
| HKR,, NV20_MODES 0" | %REG_SZ_APPEND%, | "8 | 2048 | 1536 | 60 |
| HKR,, NV20_MODES, 85 100 120 0" | %REG_SZ_APPEND%, | "16 | 640 | 480 | 60 70 72 75 |
| HKR,, NV20_MODES 0" | %REG_SZ_APPEND%, | "16 | 320 | 200 | 60 70 72 75 |
| HKR,, NV20_MODES 0" | %REG_SZ_APPEND%, | "16 | 320 | 240 | 60 70 72 75 |
| HKR,, NV20_MODES 0" | %REG_SZ_APPEND%, | "16 | 400 | 300 | 60 70 72 75 |
| HKR,, NV20_MODES 0" | %REG_SZ_APPEND%, | "16 | 480 | 300 | 60 70 72 75 |
| HKR,, NV20_MODES 0" | %REG_SZ_APPEND%, | "16 | 512 | 384 | 60 70 72 75 |

STANDARD

MODE TYPE

FIGURE 1B
(PRIOR ART)

100B

CHIP ID HEADER COLOR BIT DEPTH RESOLUTION REFRESH RATE, $H_Z$

| | | | H | V | |
|---|---|---|---|---|---|
| HKR,, NV17_MODES, 85 100 120 0" | %REG_MULT_SZ%, | "8 | 640 | 480 | 60 70 72 75 |
| HKR,, NV20_MODES, 85 100 120 0" | %REG_SZ_APPEND%, | "16 | 640 | 400 | 60 70 72 75 |
| HKR,, NV20_MODES, 85 100 120 0" | %REG_SZ_APPEND%, | "16 | 800 | 600 | 60 70 72 75 |
| HKR,, NV20_MODES, 85 100 120 0" | %REG_SZ_APPEND%, | "16 | 1024 | 768 | 60 70 72 75 |
| HKR,, NV20_MODES, 85 100 120 0" | %REG_SZ_APPEND%, | "16 | 1152 | 864 | 60 70 72 75 |
| HKR,, NV20_MODES, 85 100 120 0" | %REG_SZ_APPEND%, | "16 | 1280 | 768 | 60 70 72 75 |
| HKR,, NV20_MODES, 85 100 120 0" | %REG_SZ_APPEND%, | "16 | 1280 | 960 | 60 70 72 75 |
| HKR,, NV20_MODES, 85 100 120 0" | %REG_SZ_APPEND%, | "16 | 1280 | 1024 | 60 70 72 75 |
| HKR,, NV20_MODES, 85 100 0" | %REG_SZ_APPEND%, | "16 | 1600 | 900 | 60 70 72 75 |
| HKR,, NV20_MODES, 85 100 0" | %REG_SZ_APPEND%, | "16 | 1600 | 1024 | 60 70 72 75 |

STANDARD

MODE TYPE

FIGURE 1B (PRIOR ART) CONT.

HEADER 810 | 815A | 815B | 815C

HKR, , NV_Modes, %REG_MULTI_SZ%, " { * }S 720x480 720x576=1; 320x200 640x400=2B; SHV

815C | 815D | 815E

1920x1200x32=1; {100-309} SH 2048x1536x32=1; 1600x900x32 1920x1200x8, 16=8014;

815F | 815G

{100-18B, 200}SV 1920x1080x32=10; 1920x1440x32 2048x1536x8, 16=39;"

900

| CHIP ID 910 | H x V RESOLUTION 920 | COLOR BIT DEPTHS 930 | REFRESH RATE, $H_Z$ 940 | COMMENTS 950 |
|---|---|---|---|---|
| (ALL) DON'T CARE | 720x480 | 8,16,32 | $60H_Z$ | |
| (ALL) DON'T CARE | 720x576 | 8,16,32 | $60H_Z$ | |
| (ALL) DON'T CARE | 320x200 | 8,16,32 | $60H_Z$ ,$70H_Z$, $75H_Z$, $100H_Z$ | |
| (ALL) DON'T CARE | 640x400 | 8,16,32 | $60H_Z$ ,$70H_Z$, $75H_Z$, $100H_Z$ | |
| (ALL) DON'T CARE | 1920x1200 | 32 | $60H_Z$ | |
| (ALL) DON'T CARE | 2840x1200 | 32 | $60H_Z$ | HORIZONTAL SPANNING MODE |
| (ALL) DON'T CARE | 1920x2400 | 32 | $60H_Z$ | VERTICAL SPANNING MODE |
| 0x100-0x309 | 2048x1536 | 32 | $60H_Z$ | |
| 0x100-0x309 | 4096x1536 | 32 | $60H_Z$ | HORIZONTAL SPANNING MODE |
| 0x100-0x309 | 1600x900 | 32 | $20H_Z$ | CUSTOM REFRESH RATE |
| 0x100-0x309 | 3200x900 | 32 | $20H_Z$ | HORIZONTAL SPANNING MODE, CUSTOM REFRESH RATE |
| 0x100-0x309 | 1920x1200 | 8, 16 | $20H_Z$ | CUSTOM REFRESH RATE |
| 0x100-0x309 | 3840x1200 | 8, 16 | $20H_Z$ | HORIZONTAL SPANNING MODE, CUSTOM REFRESH RATE |
| 0x100-0x18B, 0x200 | 1920x1080 | 32 | $85H_Z$ | |
| 0x100-0x18B, 0x200 | 1920x2160 | 32 | $85H_Z$ | VERTICAL SPANNING MODE |
| 0x100-0x18B, 0x200 | 1920x1440 | 32 | $60H_Z$,$75H_Z$, $85H_Z$, $100H_Z$ | |
| 0x100-0x18B, 0x200 | 1920x2880 | 32 | $60H_Z$,$75H_Z$, $85H_Z$, $100H_Z$ | VERTICAL SPANNING MODE |
| 0x100-0x18B, 0x200 | 2048x1536 | 8, 16 | $60H_Z$,$75H_Z$, $85H_Z$, $100H_Z$ | |
| 0x100-0x18B, 0x200 | 2048x3072 | 8, 16 | $60H_Z$,$75H_Z$, $85H_Z$, $100H_Z$ | VERTICAL SPANNING MODE |

FIGURE 9

1000

```
HKR, , NV_Modes, %REG_MULTI_SZ%, "{ * } S 720x480 720x576=1; 320x200 320x240 400x300
480x360 512x384 640x400=F;SHV 1920x1200x32=1; 1600x1200x8, 16=1D; 640x480 800x600
1024x768 1280x1024=3D; 1600x1200x32 1920x1200x8, 16=D;{ 100-338} SHV
2048x1536x32=1; 1920x1440x8, 16=10; 1920x1200x32=1C; 1600x900x32 1600x1200x32
1920x1200x8, 16=20; 1920x1440x32=8; 2048x1536x8, 16=C; { 100-18B, 200-338} SHV
1920x1080x32=10; 1024x768x8, 16=1000; 848x480=1DFF; 1920x1440x32
2048x1536x8, 16=2; 1600x1024x32=20; "
HKR, , NV_Modes, %REG_SZ_APPEND%, "1280x720x32 1280x768x32 1280x960x32
1280x1024x32=280; 1360x768x32=2FF; 1600x900x8, 16=380; 1600x900x32 1600x1024x8, 16
1600x1200x8, 16=40; 1152x864x32 1280x720x8, 16 1280x768x8,16 1280x960x8, 16
1280x1024x8, 16=400; 1360x768x8, 16=7FF; 1024x768x32 1152x864x8, 16=800; { 20-18B, 200-
338} SHV 800x600=1DC2; 1600x1024x8, 16 1920x1080x8, 16=1F; 640x480=1FC2; 1280x1024x32
1600x1200
1920x1200x8, 16=2; 1152x864x8, 16=3FF; 1280x1024x8, 16=42; 1920x1080x32=7; 1024x768=7C2
;1600x1024x32=F; 1152x864x32=FF; "
HKR, , NV_Modes, %REG_SZ_APPEND%, "{ 28-29, 2D-338} SHV 1920x1440x32
2048x1536x8, 16=1; 1600x1200x32
1920x1200x8, 16=10; 1600x900x32=1D; 1600x1200x8, 16=20; 1280x768
1600x900x8, 16=3D; 1920x1440x8, 16=D; { 28-29, 2D-18B, 200-338} SHV
1600x1024x32=10; 1600x900x32 1920x1200x32 1920x1440x8, 16=2; 1600x1024x8, 16
1920x1080x8, 16=20; 1152x864x32=200; 1280x1024x8, 16=380; 1280x768x8, 16=3C2; 1280x720x
8,16 1280x960x8, 16=3FF; 1280x1024x32=40; 1152x864x8, 16=400; 1280x768x32
1600x900x8, 16=42; 1280x720x32 1280x960x32=7F; 1920x1080x32=8; "
HKR, , NV_Modes, %REG_SZ_APPEND%, " 1024x768x8, 16=800; { 1A0, 1F0} SHV 1920x1200x32
1920x1440x8, 16 2048x1536x8, 16=20; 800x480=3D; { 1A0-1F0, 300-338} SHV
2048x1536x8, 16=10; 1920x1440x32 2048x1536x32=4; { 258-25B, 288-289, 308-309, 318-
319, 32A-32F, 338} S 3840x2400=800D; 1920x1200=8029; SH
1920x2400=8014; 1920x2400=8018; 1920x2400=8019; SV
3840x1200=8015; 3840x1200=8018; { 300-338} SHV 1920x1400x32=10; 1152x864x32
1280x720x32 1280x768x32 1280x960x32 1280x1024x32
1360x768x32=100; 2048x1536x32=1A; 800x600 848x480=200; "
```

FIGURE 10

METHOD AND SYSTEM USING COMPRESSED DISPLAY MODE LIST

CROSS REFERENCE TO RELATED U.S. APPLICATION

This patent application claims the benefit of U.S. Provisional Patent Application Ser. No. 60/461,714, filed Apr. 9, 2003, entitled "Compressed Display Modes," by Yu Dong, Dongyi Liao, and Gregory P. Kwok.

BACKGROUND OF THE INVENTION

1. Field of the Invention

Embodiments of the present invention generally relate to graphical processing systems and drivers. More particularly, embodiments of the present invention relate to display mode list having display modes supported by the graphical processing systems and drivers.

2. Related Art

A driver is used to control the graphical processing system (or graphics card) in a computer system. The graphical processing system renders an image to display on a display device according to a display mode that is selected by the user. Typically, the graphical processing system supports a variety of display modes that are included in a display mode list. The display mode list generally is dependent on the graphical processing unit (or graphics processor chip) of the graphical processing system. The display mode list associated with a particular graphical processing unit is usually different from the display mode list associated with another graphical processing unit.

Typically, when the driver for the graphical processing system is installed on a computer system, the appropriate display mode list is also installed on the computer system. The display mode list may be part of an INF file, which is a text file divided into different types of formatted sections. During execution, the operating system of the computer system may store the display mode list in the registry.

FIG. 1A illustrates a portion of a first conventional display mode list 100A. As illustrated in FIG. 1A, the first conventional display mode list 100A includes a header, a color bit depth, a resolution, a refresh rate, and a chip ID. The color bit depth represents the number of color bits per pixel. The resolution represents horizontal pixel H and vertical pixel V numbers. The chip ID represents the graphical processing unit to which the display mode list is associated. The refresh rates, which follow the color bit depth and the resolution, represent a list of refresh rates available/supported given the specific values for the color bit depth and the resolution. Moreover, the first conventional display mode list 100A also includes a mode type which indicates whether the graphical processing unit supports spanning the image across two display devices. For example, if the mode type is standard, the image is displayed on a single display device. If the mode type is vertical spanning mode, the image is displayed on two vertically stacked display devices, doubling the vertical resolution. Additionally, if the mode type is horizontal spanning mode, the image is displayed on two horizontally stacked display devices, doubling the horizontal resolution. Similarly, FIG. 1B illustrates a portion of a second conventional display mode list 100B associated with a different graphical processing unit. As illustrated in FIG. 1B, the second conventional display mode list 100B includes a header, a color bit depth, a resolution, a refresh rate, a chip ID, and a mode type.

The first conventional display mode list 100A and the second conventional display mode list 100B can be very large in this flat or raw format. This can create problems in the registry if the operating system fails to provide enough storage space for these conventional display mode lists 100A and 100B. In particular, these problems become more severe if the driver, which is installed on the computer system, is based on a unified driver architecture. A driver that is based on a unified driver architecture supports a variety of graphical processing units to provide both forward and backward compatibility across the graphical processing units. Hence, the display mode lists for the variety of graphical processing units supported by the driver are installed in the computer system, creating a large display mode list that can be several megabytes in size.

SUMMARY OF THE INVENTION

A method and system using a compressed display mode list is disclosed. In particular, the compressed display mode list includes a plurality of data representing the display modes. The data is formatted according to a plurality of compression format rules. The compression format rules reduce and minimize the size of the compressed display mode list. A driver controls a graphical processing unit that renders an image for displaying on a display device according to a selected display mode from the compressed display mode list. Moreover, a computer-readable medium can store the compressed display mode list.

BRIEF DESCRIPTION OF THE DRAWINGS

The accompanying drawings, which are incorporated in and form a part of this specification, illustrate embodiments of the invention and, together with the description, serve to explain the principles of the present invention.

FIG. 1A illustrates a portion of a first conventional display mode list.

FIG. 1B illustrates a portion of a second conventional display mode list.

FIG. 9 illustrates a table showing the display modes included in the first compressed display mode list of FIGS. 8A and 8B in accordance with an embodiment of the present invention.

FIG. 10 illustrates a second compressed display mode list used with a driver based on a unified driver architecture in accordance with an embodiment of the present invention.

DETAILED DESCRIPTION OF THE INVENTION

Reference will now be made in detail to the preferred embodiments of the present invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention.

Figure 2:
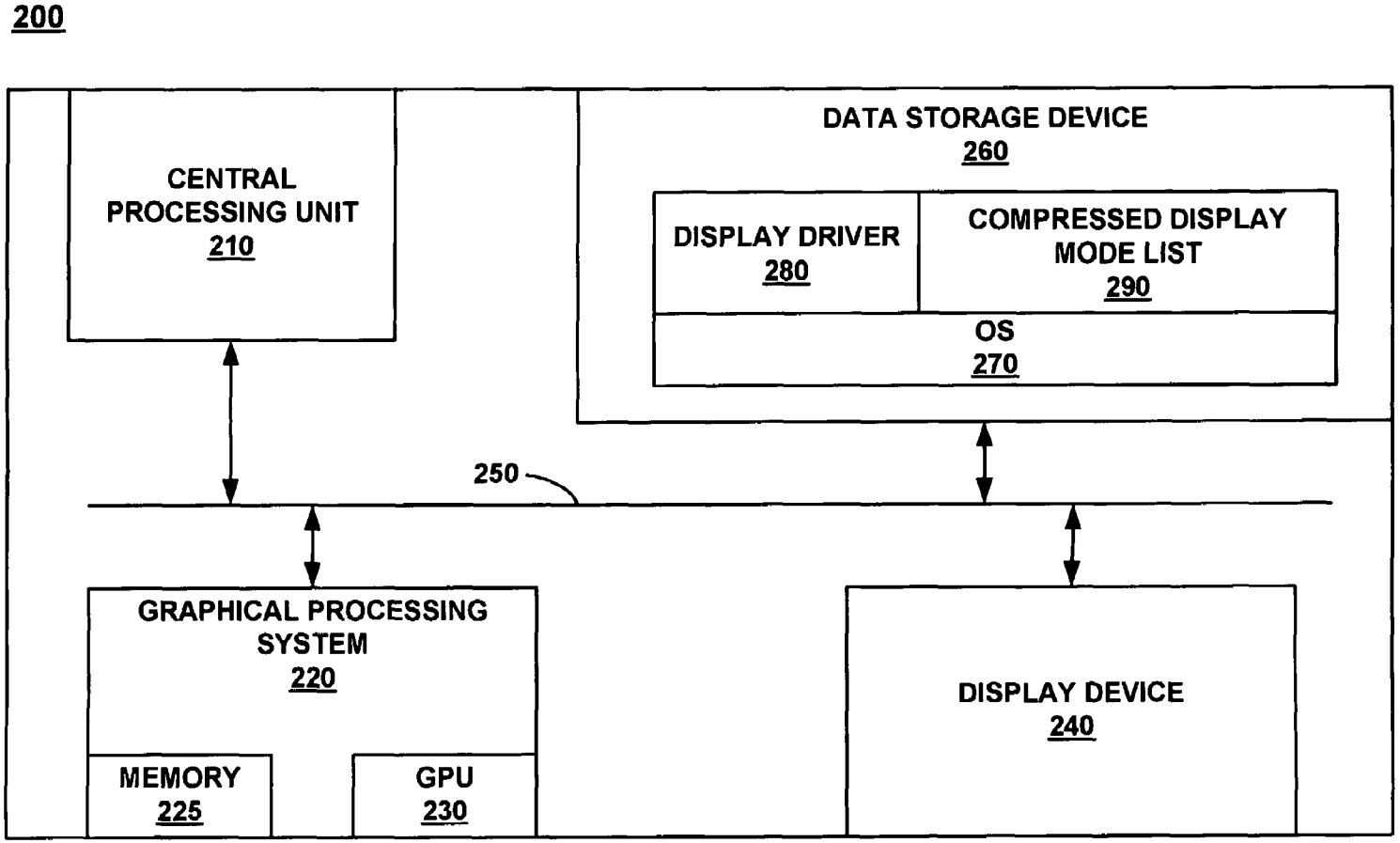
FIG. 2 illustrates a system having a compressed display mode list in accordance with an embodiment of the present invention.

FIG. 2 illustrates a system 200 having a compressed display mode list 290 in accordance with an embodiment of the present invention. The system 200 includes a central processing unit 210, a bus 250, a graphical processing system 220, a display device 240, and a storage device 260. The storage device 260 includes a display driver 280, a compressed display mode list 290, and an operating system 270. The storage device 260 can be any type of computer-readable medium that stores computer-executable instructions, such as a magnetic disk, CD-ROM, an optical medium, a floppy disk, a flexible disk, a hard disk, a magnetic tape, a RAM, a ROM, a PROM, an EPROM, a flash-EPROM, or any other medium from which a computer can read.

The graphical processing system 220 includes a memory 225 and a graphical processing unit 230. The graphical processing unit 230 renders an image to display on the display device 240 according to a display mode selected by a user. The display mode includes a mode type, a color bit depth, a resolution, and a refresh rate, as described above.

The display driver 280 controls the graphical processing system 220 and the graphical processing unit 230. In an embodiment, the display driver 280 is based on a unified driver architecture. Hence, the display driver 280 supports a variety of graphical processing units, requiring the compressed display mode list 290 to include the display modes supported by the variety of graphical processing units. The compressed display mode list 290 includes a plurality of data representing the display modes. The data is formatted according to a plurality of compression format rules, as will be described below. In an embodiment, the compressed display mode list 290 is a text file.

Figure 3A:
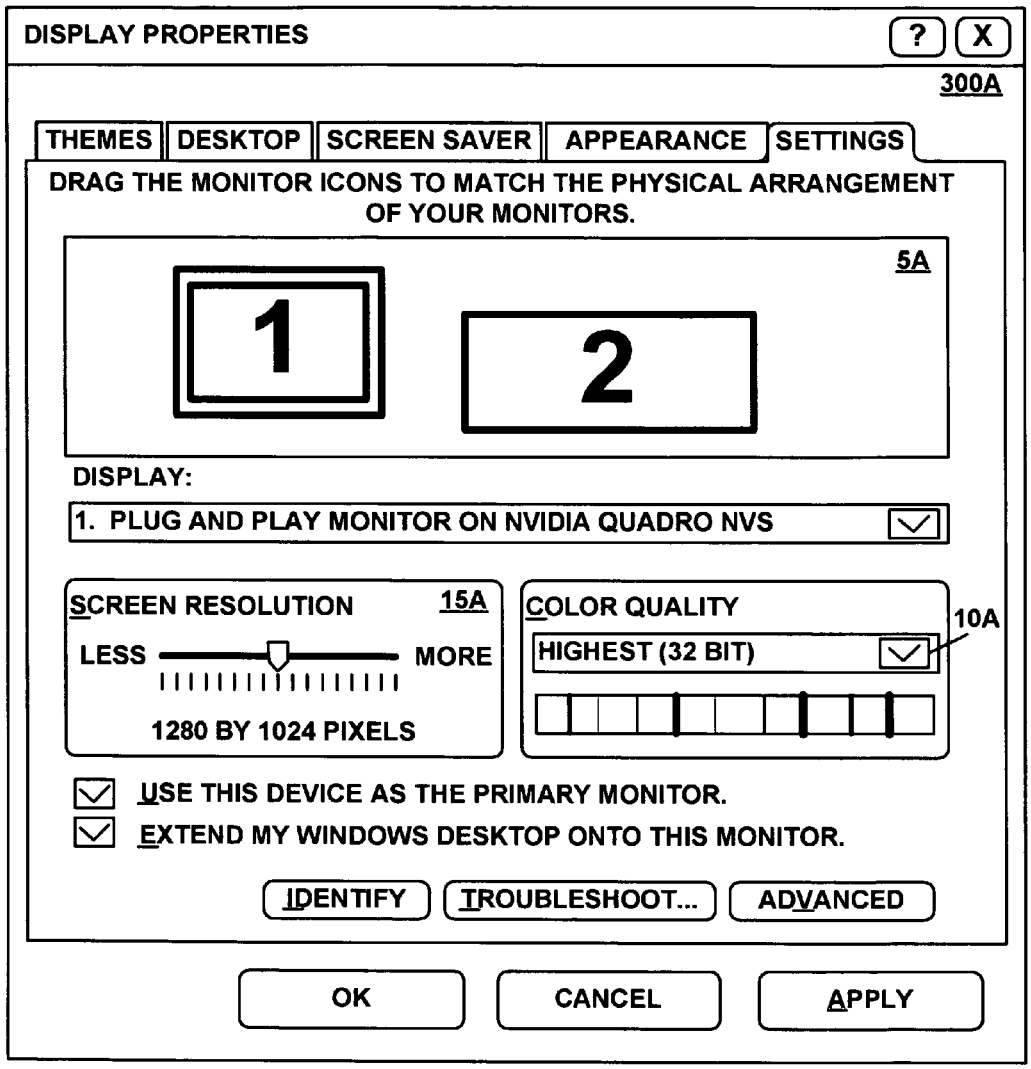
FIGS. 3A–3E illustrate use of the compressed display mode list in accordance with an embodiment of the present invention.

FIGS. 3A–3E illustrate use of the compressed display mode list 290 (FIG. 2) in accordance with an embodiment of the present invention. In FIG. 3A, the user is provided a display properties window 300A with a variety of selectable display options 5A, 10A, and 15A. The compressed display mode list 290 is read to supply the display modes listed in the display properties window 300A for the corresponding graphical processing unit 230 (FIG. 2) of the system 200 (FIG. 2). In the resolution option 15A, the user has selected 1280×1024 pixels. In the color bit depth option 10A, the user has selected 32 bits per pixel. Moreover, in the mode type option 5A, the user has selected the standard mode.

Figure 3B:
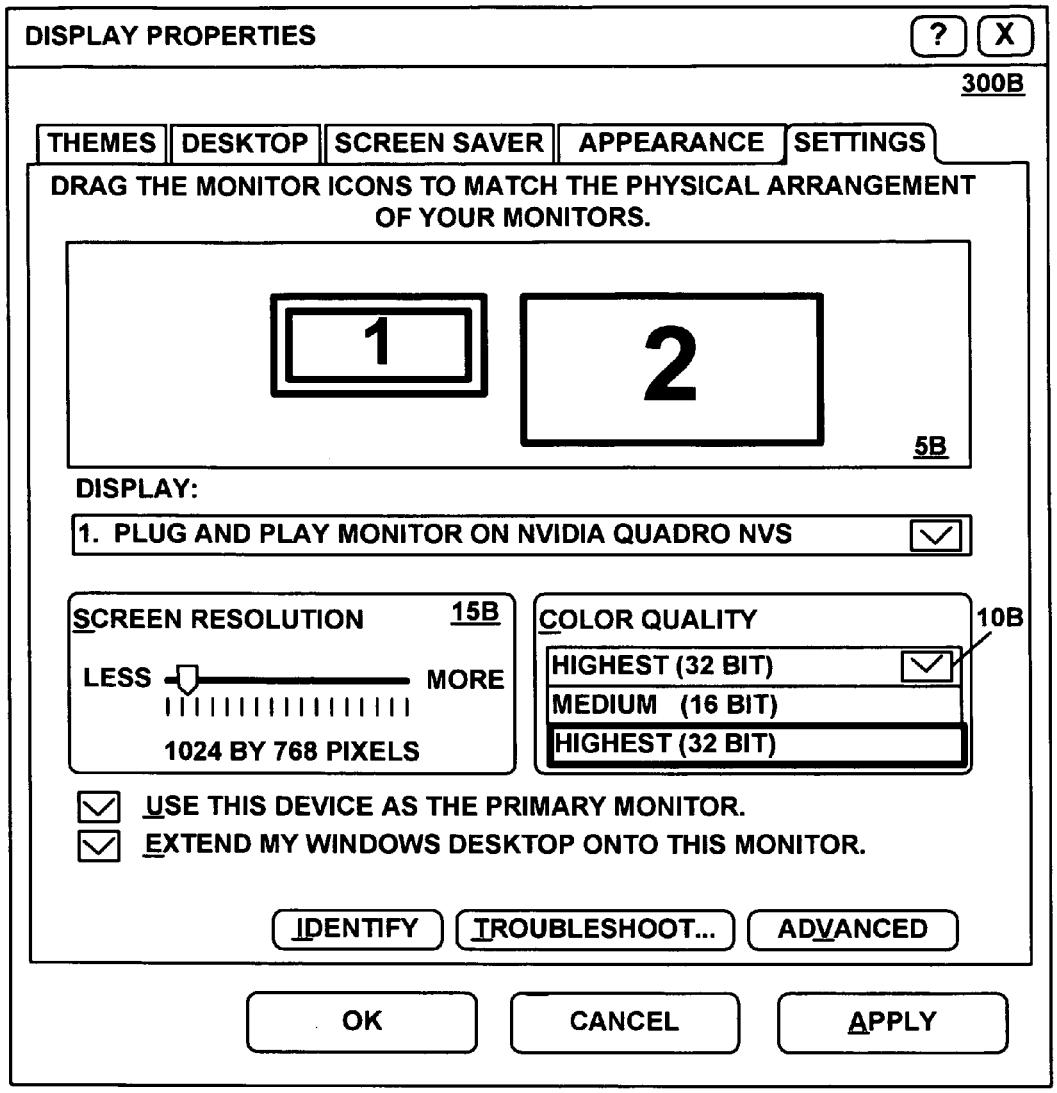

In FIG. 3B, the user is provided a display properties window 300B with a variety of selectable display options 5B, 10B, and 15B. The compressed display mode list 290 is read to supply the display modes listed in the display properties window 300B for the corresponding graphical processing unit 230 (FIG. 2) of the system 200 (FIG. 2). In the resolution option 15B, the user has selected 1024×768 pixels. In the color bit depth option 10B, the user has selected 32 bits per pixel. Moreover, in the mode type option 5B, the user has selected the standard mode.

Figure 3C:
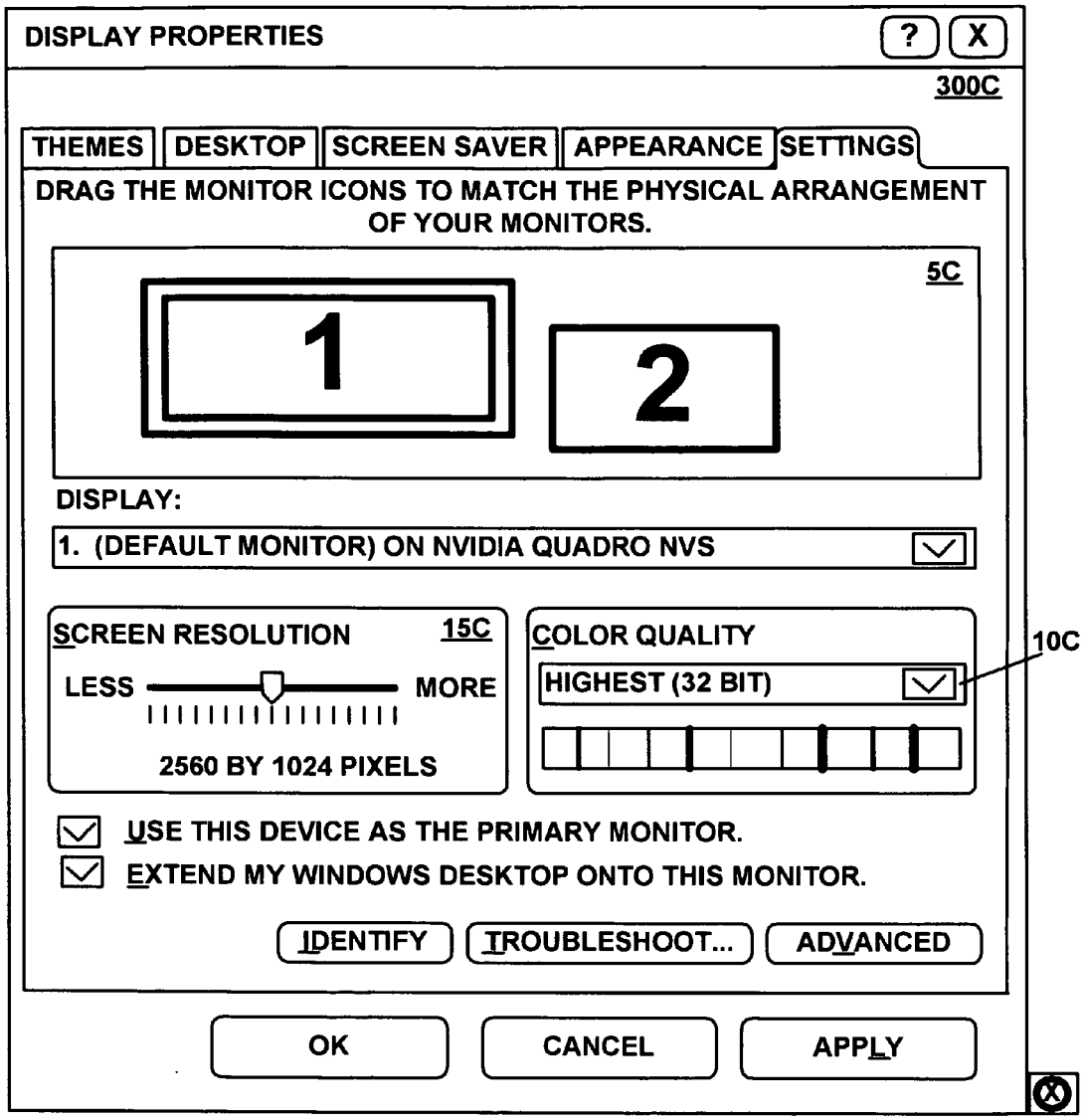

In FIG. 3C, the user is provided a display properties window 300C with a variety of selectable display options 5C, 10C, and 15C. The compressed display mode list 290 is read to supply the display modes listed in the display properties window 300C for the corresponding graphical processing unit 230 (FIG. 2) of the system 200 (FIG. 2). In the resolution option 15C, the user has selected 2560×1024 pixels, which corresponds to doubling the horizontal resolution selected in FIG. 3A. In the color bit depth option 10C, the user has selected 32 bits per pixel. Moreover, in the mode type option 5C, the user has selected the horizontal span mode, whereas the image is displayed on two horizontally stacked display devices.

Figure 3D:
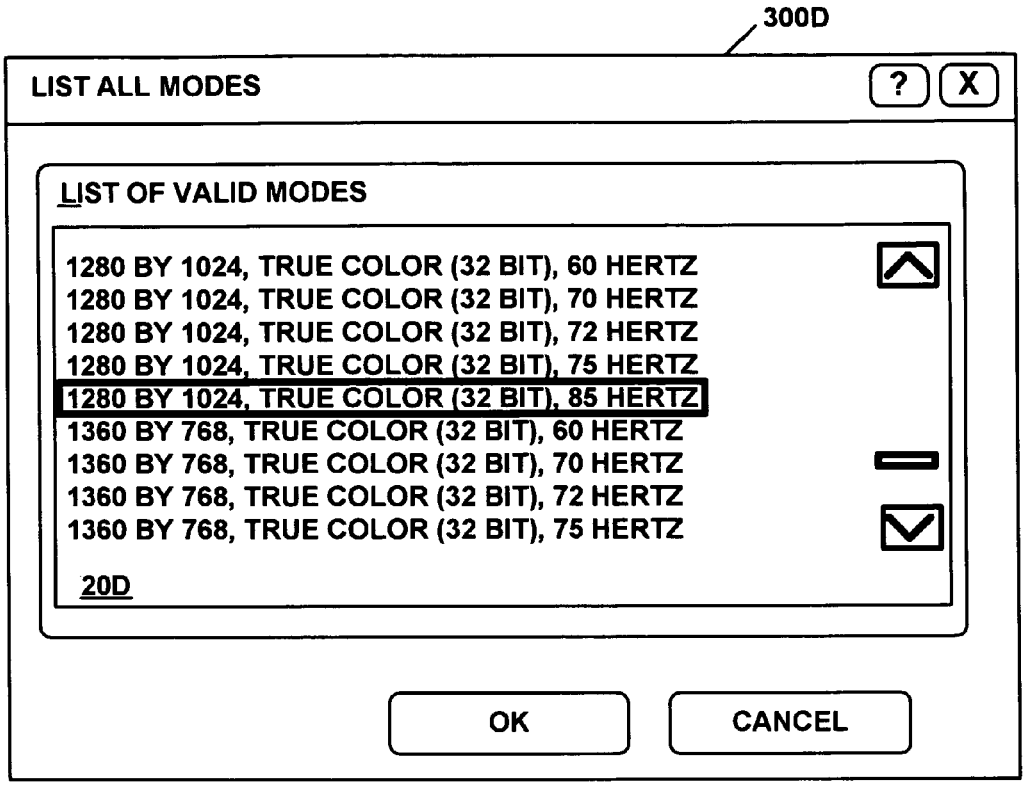

Additionally, in FIG. 3D the user is provided a window 300D with a variety of selectable display modes 20D. The compressed display mode list 290 is read to supply the display modes listed in the window 300D for the corresponding graphical processing unit 230 (FIG. 2) of the system 200 (FIG. 2). Here, the user has selected the resolution 1280×1024, the color bit depth 32 bit per pixel, and the refresh rate 85 Hz.

Figure 3E:
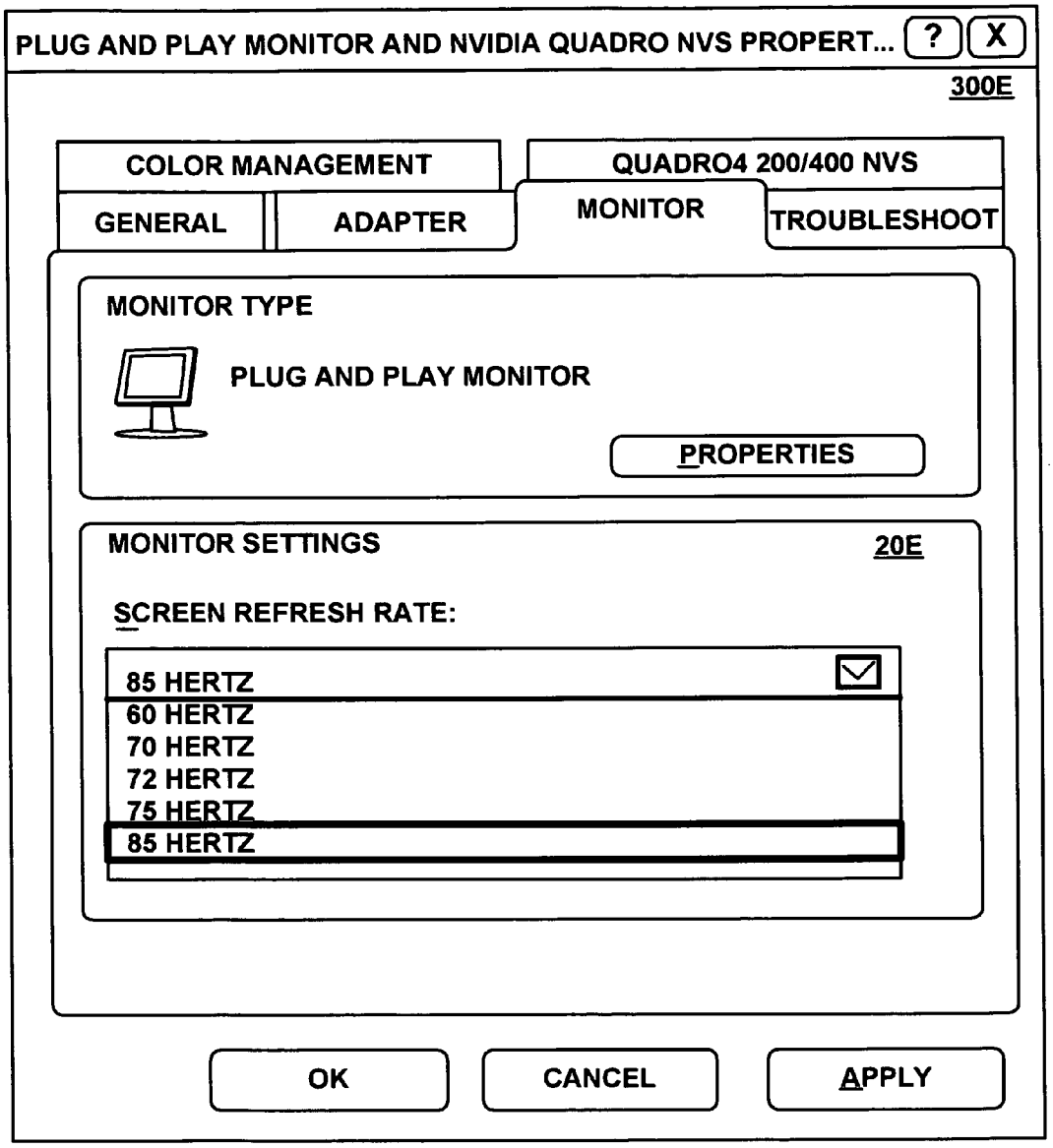

Furthermore, in FIG. 3E the user is provided a window 300E with a variety of selectable refresh rates 20E. The compressed display mode list 290 is read to supply the refresh rates shown in the window 300E for the corresponding graphical processing unit 230 (FIG. 2) of the system 200 (FIG. 2). Here, the user has selected the refresh rate 85 Hz.

Figure 4:
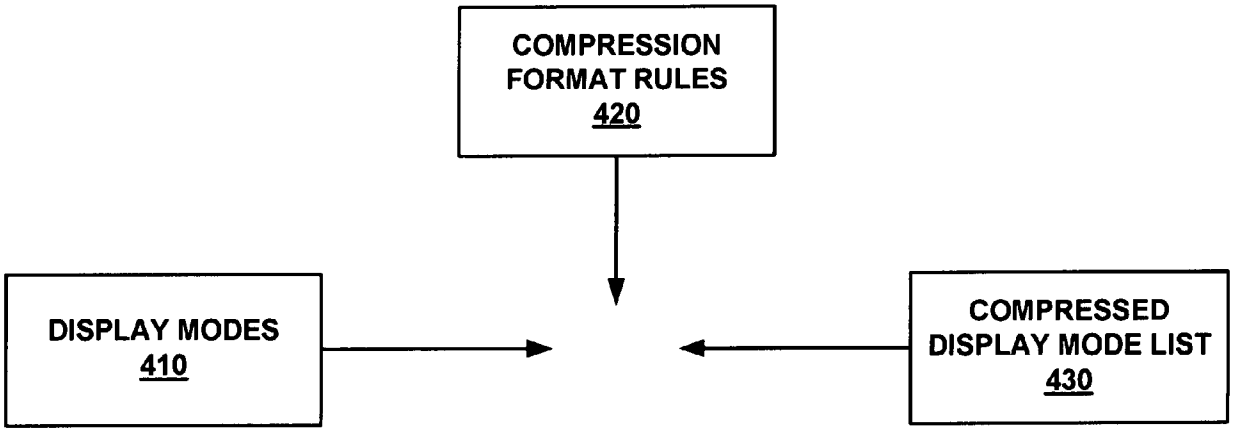
FIG. 4 illustrates creation of a compressed display mode list in accordance with an embodiment of the present invention.

FIG. 4 illustrates creation of a compressed display mode list 430 in accordance with an embodiment of the present invention. First, the display modes 410 supported by a graphical processing unit or a variety of graphical processing units are determined. Note by Comparing the first conventional display mode list 100A (FIG. 1A) and the second conventional display mode list 100B (FIG. 1B) that common data is shared by display modes within a display mode list for a graphical processing unit and across several display mode lists for several graphical processing units. Then, the compressed display mode list 430 is generated using a plurality of compression format rules and either the display modes 410 supported by a graphical processing unit or the display modes 410 supported by a variety of graphical processing units. Thus, the data representing the display modes is formatted according to compression format rules 420 that reduce and minimize the size of the compressed display mode list 430. That is, the combination of formatting and reduced use of data representing the display modes leads to the compressed display mode list 430. It should be understood that compression format rules other than those described below can be utilized.

Figure 5:
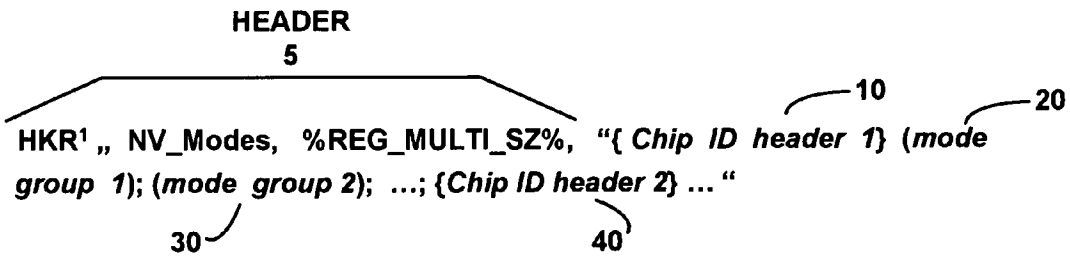
FIG. 5 illustrates a general format of a compressed display mode list in accordance with an embodiment of the present invention, showing compression format rules.

FIG. 5 illustrates a general format of a compressed display mode list in accordance with an embodiment of the present invention, showing compression format rules. The general format of the compressed display mode list includes a header 5, a chip ID header 10, and one or more mode groups (e.g., mode group 20 and mode group 30). The format of chip ID header and mode groups can be repeated as needed (e.g., chip ID header 40). The chip ID header 10 and 40 identifies a graphical processing unit or several graphical processing units that support the display modes in the mode groups that follow, until another chip ID header is encountered. Moreover, the symbol "*" can be used in the chip ID header 10 and 40 to indicate that display modes are supported by any graphical processing unit without specifying a particular graphical processing unit (e.g., don't care about the identity of the graphical processing unit). Each mode group (e.g., mode group 20 and mode group 30) describes display modes supported by the graphical processing unit(s) identified in the chip ID header 10 and 40.

Figure 6:
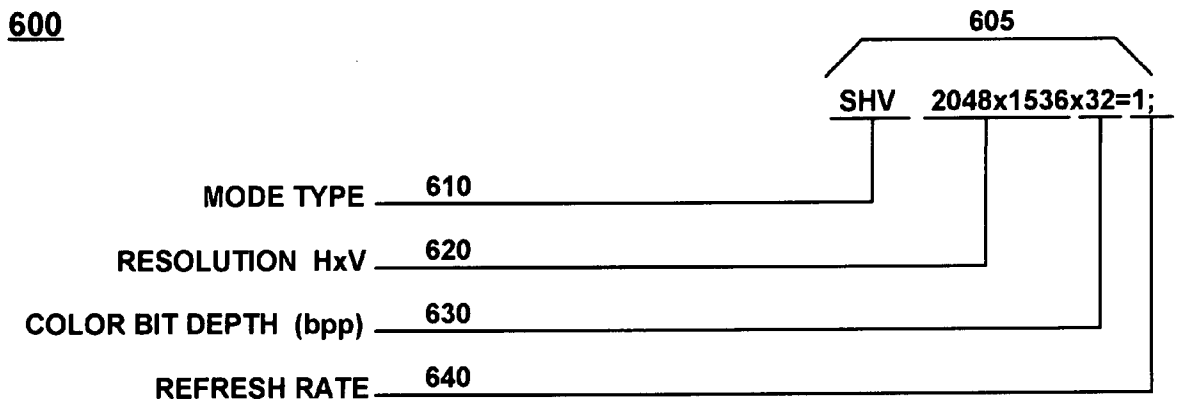
FIG. 6 illustrates a specific format of a compressed display mode list in accordance with an embodiment of the present invention, showing compression format rules.

FIG. 6 illustrates a specific format of a compressed display mode list in accordance with an embodiment of the present invention, showing compression format rules. This specific format applies to the mode groups (e.g., mode group 20 and mode group 30) described in FIG. 5. A mode group 600 has one or more display modes 605. Mode groups 600 are separated by a semicolon. Within a mode group 600, a display mode 605 can have one or more of a mode type 610, a resolution 620, a color bit depth 630, and a refresh rate 640. A display mode 605 begins with an indication of the mode type 610. The mode type 610 can be any combination of S, H, or V. The mode type S indicates standard mode. The mode type H indicates horizontal spanning mode. The mode type V indicates vertical spanning mode. For example, "SH 800×600" specifies the display modes with resolutions 800×600 (standard) and 1600×600 (horizontal spanning) while "SV 800×600" specifies the display modes with resolutions 800×600 (standard) and 800×1200 (vertical spanning). The mode type 610 applies to display modes that follow, until another mode type is specified.

The resolution 620 is specified as horizontal resolution× vertical resolution. Moreover, the color bit depth 630 applies to the resolution that it follows. When no color bit depth 630 is specified, all color bit depths (e.g., 8, 16, and 32 bpp) are applied to the resolution that it follows. To specify a subset of the available color bit depths, the specific color bit depths are listed, separated by commas. Examples for the color bit depth 630 are [×8], [×8, 16], [×16], [×16, 32], and [×32].

Figure 7:
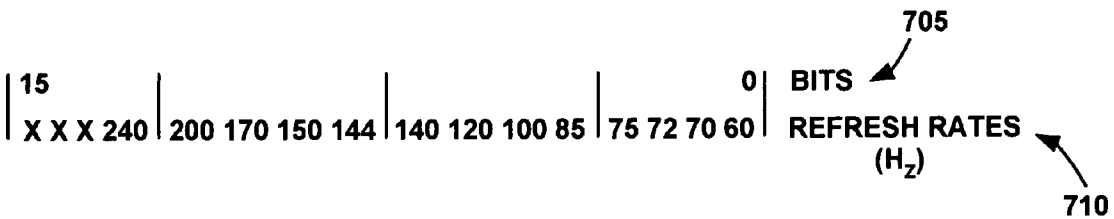
FIG. 7 illustrates a format for the refresh rate in a compressed display mode list in accordance with an embodiment of the present invention.

At the end of each mode group 600, the refresh rates 640 to apply to all display modes 605 in the mode group 600 are specified, whereas the format "=refresh rate code" is used. For standard refresh rates, the refresh rate code is a hexadecimal number, where each bit represents a specific refresh rate as shown in FIG. 7. FIG. 7 illustrates a format for the refresh rate in a compressed display mode list in accordance with an embodiment of the present invention. The row 705 indicates the bits of the hexadecimal number while row 710 indicates the standard refresh rates corresponding to each bit. For example, the hexadecimal number 1 corresponds to 60 Hz. The hexadecimal number 1DF (or 111011111) corresponds to 144, 140, 120, 85, 75, 72, 70 and 60 Hz.

For custom refresh rates, the refresh rate code is in the format 8XXX, where XXX is the hexadecimal representation of the custom refresh rate. For example, 8014 specifies a custom refresh rate of 20 Hz.

Figures 8A, 8B:
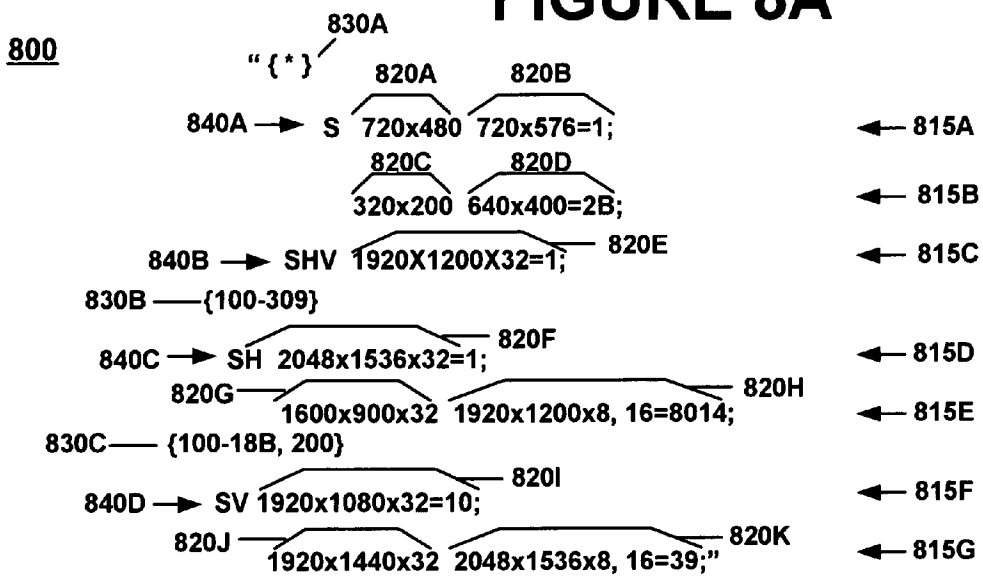
FIGS. 8A and 8B illustrate a first compressed display mode list used with a driver based on a unified driver architecture in accordance with an embodiment of the present invention.

FIGS. 8A and 8B illustrate a first compressed display mode list 800 used with a driver based on a unified driver architecture in accordance with an embodiment of the present invention. Here, the compression format rules described above have been used to reduce and minimize the size of the first compressed display mode list 800. As depicted in FIG. 8A, the first compressed display mode list 800 includes a header 810 and a plurality of mode groups 815A–815G.

Moreover, in FIG. 8B, the first compressed display mode list 800 is shown divided into sections and subsections. As shown in FIG. 8B, the mode group 815A includes the display modes 820A and 820B, sharing the refresh rate "=1". The mode group 815B includes the display modes 820C and 820D, sharing the refresh rate "=2 B". Also, the mode group 815C includes the display mode 820E. The mode group 815D includes the display mode 820F. The mode group 815E includes the display modes 820G and 820H, sharing the refresh rate "=8014". Furthermore, the mode group 815F includes the display mode 8201. The mode group 815F includes the display modes 820J and 820K, sharing the refresh rate "=39".

In addition, the mode type 840A (e.g., S) applies to the display modes 820A–820D. The mode type 840B (e.g., SHV) applies to the display mode 820E. The mode type 840C (e.g., SH) applies to the display modes 820F–820H. The mode type 840D (e.g., SV) applies to the display modes 820I–820K.

Continuing, the chip ID header 830A (e.g., "*") applies to the group modes 815A–815C. The chip ID header 830B (e.g., 100–309) applies to the group modes 815D–815E. The chip ID header 830C (e.g., 100–18B, 200) applies to the group modes 815F–815G.

FIG. 9 illustrates a table 900 showing the display modes included in the first compressed display mode list 800 of FIGS. 8A and 8B in accordance with an embodiment of the present invention. The table 900 has columns corresponding to chip ID 910, resolution 920, color bit depth 930, refresh rate 940, and comments 950. The first compressed display mode list 800 provides a compact format compared to the unformatted data in the table 900. Since the size of the first compressed display mode list 800 is reduced, storage capacity problems in the registry are eliminated.

Moreover, FIG. 10 illustrates a second compressed display mode list 1000 used with a driver based on a unified driver architecture in accordance with an embodiment of the present invention. This second compressed display mode list 1000 provides the display modes for approximately 30 different graphical processing units. The size of this second compressed display mode list 1000 is approximately 2% of the size of the conventional display mode list (e.g., FIG. 1A and FIG. 1B), providing a compression rate of approximately 98%. Hence, the compression format rules described above serve to eliminate problems with the registry.

Embodiments of the present invention can be implemented as data structures. The data structures can be stored in a computer-readable medium. Data structures organized according to the present invention have a size that is reduced and minimized compared to the size of conventional data structures due to the use of compression format rules.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents.

What is claimed is:

1. A graphical processing system comprising:

a first graphical processing unit for rendering an image to display on a display device according to a selected one of a plurality of display modes;

a driver for controlling said first graphical processing unit; and a display mode list including a plurality of data representing said display modes, wherein said data is formatted according to a plurality of compression format rules that reduce amount of area on said display device required to display in a user-readable manner said display mode list and that reduce amount of memory required to store said display mode list.

2. The graphical processing system as recited in claim 1 wherein each display mode includes a mode type, a resolution, a color bit depth, and a refresh rate.

3. The graphical processing system as recited in claim 1 wherein said driver is based on a unified driver architecture.

4. The graphical processing system as recited in claim 1 wherein said compression format rules minimize a size of said data representing said display modes supported by said first graphical processing unit.

5. The graphical processing system as recited in claim 1 wherein said compression format rules minimize a size of said data representing said display modes supported by a plurality of graphical processing units including said first graphical processing unit.

6. The graphical processing system as recited in claim 1 wherein said display mode list is a text file.

7. A computer-readable medium comprising computer-executable instructions stored therein that provide:

a driver for controlling a first graphical processing unit that renders an image for displaying on a display device according to a selected one of a plurality of display modes; and a display mode list including a plurality of data representing said display modes, wherein said data is formatted according to a plurality of compression format rules that reduce amount of area on said display device required to display in a user-readable manner said display mode list and that reduce amount of memory required to store said display mode list.

8. The computer-readable medium as recited in claim 7 wherein each display mode includes a mode type, a resolution, a color bit depth, and a refresh rate.

9. The computer-readable medium as recited in claim 7 wherein said driver is based on a unified driver architecture.

10. The computer-readable medium as recited in claim 7 wherein said compression format rules minimize a size of said data representing said display modes supported by said first graphical processing unit.

11. The computer-readable medium as recited in claim 7 wherein said compression format rules minimize a size of said data representing said display modes supported by a plurality of graphical processing units including said first graphical processing unit.

12. The computer-readable medium as recited in claim 7 wherein said display mode list is a text file.

13. A system comprising:

a display device;

a first graphical processing system for rendering an image to display on said display device according to a selected one of a plurality of display modes;

a driver for controlling said first graphical processing system; and a display mode list including a plurality of data representing said display modes, wherein said data is formatted according to a plurality of compression format rules that reduce amount of area on said display device required to display in a user-readable manner said display mode list and that reduce amount of memory required to store said display mode list.

14. The system as recited in claim 13 wherein each display mode includes a mode type, a resolution, a color bit depth, and a refresh rate.

15. The system as recited in claim 13 wherein said driver is based on a unified driver architecture.

16. The system as recited in claim 13 wherein said compression format rules minimize a size of said data representing said display modes supported by said first graphical processing system.

17. The system as recited in claim 13 wherein said compression format rules minimize a size of said data representing said display modes supported by a plurality of graphical processing systems including said first graphical processing system.

18. The system as recited in claim 13 wherein said display mode list is a text file.

19. A method of creating a display mode list, comprising:

determining a plurality of first display modes supported by a first graphical processing unit; and generating said display mode list using first data representing said first display modes and a plurality of compression format rules that reduce amount of area on a display device required to display in a user-readable manner said display mode list and that reduce amount of memory required to store said display mode list.

20. The method as recited in claim 19 further comprising:

determining a plurality of second display modes supported by a second graphical processing unit; and generating said display mode list using said first data representing said first display modes, second data representing said second display modes, and said compression format rules.

21. The method as recited in claim 20 wherein each first display mode and each second display mode include a mode type, a resolution, a color bit depth, and a refresh rate.

22. The method as recited in claim 20 wherein said compression format rules minimize a size of said first data representing said first display modes supported by said first graphical processing unit.

23. The method as recited in claim 20 wherein said compression format rules minimize a size of said first data representing said first display modes supported by said first graphical processing unit and minimize a size of said second data representing said second display modes supported by said second graphical processing unit.

24. The method as recited in claim 20 wherein said display mode list is a text file.

25. A method of providing selectable display options to a user, comprising:

reading a display mode list including a plurality of data representing a plurality of display modes, wherein said data is formatted according to a plurality of compression format rules that reduce amount of area on a display device required to display in a user-readable manner said display mode list and that reduce amount of memory required to store said display mode list; and displaying said selectable display options to said user based on said display modes.

26. The method as recited in claim 25 wherein each display mode includes a mode type, a resolution, a color bit depth, and a refresh rate.

27. The method as recited in claim 25 wherein said compression format rules minimize a size of said data representing said display modes supported by a first graphical processing system.

28. The method as recited in claim 25 wherein said compression format rules minimize a size of said data representing said display modes supported by a plurality of graphical processing systems.

29. The method as recited in claim 25 wherein said display mode list is a text file.

30. An apparatus comprising:

a driver for controlling a first graphical processing unit that renders an image for displaying on a display device according to a selected one of a plurality of display modes; and a display mode list including a plurality of data representing said display modes, wherein said data is formatted according to a plurality of compression format rules that reduce amount of area on said display device required to display in a user-readable manner said display mode list and that reduce amount of memory required to store said display mode list.

31. The apparatus as recited in claim 30 wherein each display mode includes a mode type, a resolution, a color bit depth, and a refresh rate.

32. The apparatus as recited in claim 30 wherein said driver is based on a unified driver architecture.

33. The apparatus as recited in claim 30 wherein said compression format rules minimize a size of said data representing said display modes supported by said first graphical processing unit.

34. The apparatus as recited in claim 30 wherein said compression format rules minimize a size of said data representing said display modes supported by a plurality of graphical processing units including said first graphical processing unit.

35. The apparatus as recited in claim 30 wherein said display mode list is a text file.

* * * * *